US005275716A

United States Patent [19]

Kojima et al.

[11] Patent Number: 5,275,716

[45] Date of Patent: Jan. 4, 1994

[54] METHOD FOR MANUFACTURING TIN-ELECTROPLATED COLD-ROLLED STEEL STRIP

[75] Inventors: Katsumi Kojima; Mikiyuki Ichiba; Hiroki Iwasa; Toyofumi Watanabe, all of Tokyo, Japan

[73] Assignee: NKK Corporation, Tokyo, Japan

[21] Appl. No.: 29,781

[22] Filed: Mar. 11, 1993

[30] Foreign Application Priority Data

Mar. 23, 1992 [JP] Japan ..... 4-095872
Mar. 23, 1992 [JP] Japan ..... 4-095873

[51] Int. Cl.[5] ..... C25D 7/06
[52] U.S. Cl. ..... 205/154; 205/197
[58] Field of Search ..... 205/154, 197

[56] References Cited

U.S. PATENT DOCUMENTS 2,384,086 9/1945 Glock ..... 205/80
2,974,091 3/1961 Neish ..... 205/80

FOREIGN PATENT DOCUMENTS 3-177597 8/1991 Japan .
3-207887 9/1991 Japan .
1131679 10/1968 United Kingdom .

*Primary Examiner*—T. M. Tufariello
*Attorney, Agent, or Firm*—Frishauf, Holtz, Goodman & Woodward

[57] ABSTRACT

A method for manufacturing a tin-electroplated cold-rolled steel strip, which comprises the steps of: continuously annealing a degreased cold-rolled steel strip; then, subjecting, following the continuous annealing treatment, the continuously annealed cold-rolled steel strip to a continuous tin-electroplating treatment in a tin-electroplating bath to form, on at least one surface of the cold-rolled steel strip, a tin-electroplating layer having a plating weight within a range of from 0.1 to 2.8 g/m$^2$ per surface of the cold-rolled steel strip; and then, temper-rolling, following the continuous tin-electroplating treatment, the cold-rolled steel strip having the tin-electroplating layer on at least one surface thereof, at a reduction ratio within a range of from 1 to 5%.

14 Claims, 2 Drawing Sheets

METHOD FOR MANUFACTURING TIN-ELECTROPLATED COLD-ROLLED STEEL STRIP

REFERENCE TO PATENTS, APPLICATIONS AND PUBLICATIONS PERTINENT TO THE INVENTION

As far as we know, there are available the following prior art documents pertinent to the present invention:

(1) Japanese Patent Provisional Publication No. 3-177,597 published on Aug. 1, 1991; and (2) Japanese Patent Provisional Publication No. 3-207,887 published on Sep. 11, 1991.

The contents of the prior art disclosed in the above-mentioned prior art documents will be discussed hereafter under the heading of the "BACKGROUND OF THE INVENTION."

BACKGROUND OF THE INVENTION

Field of the Invention

The present invention relates to a method for manufacturing a tin-electroplated cold-rolled steel strip mainly used for a can body of a drawn and ironed can (hereinafter referred to as the "DI can") which is a kind of a two-piece can comprising a cup-shaped can body and a top.

Related Art Statement

The DI can manufactured by a drawing and ironing forming (hereinafter referred to as the "DI forming") has a thinner thickness of the can body and hence a lighter weight and requires a smaller consumption of a metal sheet per can, as compared with a can known as the three-piece can comprising a top, a bottom and a can body prepared by soldering or welding. The DI can has therefore an advantage of a lower manufacturing cost over the three-piece can.

The DI can has conventionally been used exclusively as a can for beer or a carbonated beverage, in which an internal pressure is applied to the side wall of the can by means of a content filled in the can, and an external pressure against the side wall of the can may thus be coped with. Recently, however, development of a technology of filling a can with a nitrogen gas to apply an internal pressure to the side wall of the can, has come to permit filling of the DI can with various contents, not limited to beer or a carbonated beverage. As a result, the demand for the DI cans is yearly increasing.

As a metal sheet for the DI can, a tin-electroplated cold-rolled steel sheet or an aluminum sheet is usually employed. Since the tin-electroplated cold-rolled steel sheet is less expensive than the aluminum sheet, growth of demand for the DI cans made of the tin-electroplated cold-rolled steel sheet is expected.

The tin-electroplated cold-rolled steel sheet is usually manufactured by the following steps: A cold-rolled steel strip is degreased, then subjected to a continuous annealing treatment, and then pickled. The cold-rolled steel strip which has thus been continuously annealed and pickled is then temper-rolled. Then the temper-rolled cold-rolled steel strip is subjected to a continuous tin-electroplating treatment in a tin-electroplating bath to form a tin-electroplating layer on at least one surface of the cold-rolled steel strip. The thus manufactured tin-electroplated cold-rolled steel strip is cut into a sheet having a prescribed dimension.

Upon manufacturing a tin-electroplated cold-rolled steel strip by means of the above-mentioned steps, the cold-rolled steel strip has conventionally been wound into a coil for each steps of the continuous annealing and the temper rolling. This practice has posed the following problems:

(1) Each of the above-mentioned steps requires facilities for coiling and uncoiling the cold-rolled steel strip and facilities for storage of the coiled cold-rolled steel strip and for transportation thereof to the next step. This in turn requires higher equipment and running costs.

(2) Oxides and the like are inevitably produced on the surface of the cold-rolled steel strip in each of the above-mentioned steps. A step for eliminating oxides and the like is therefore necessary prior to subjecting the cold-rolled steel strip to a continuous tin-electroplating treatment. This requires higher equipment and running costs. Furthermore, incomplete elimination of oxides and the like causes quality degradation of the tin-electroplated cold-rolled steel strip.

As means of solving the above-mentioned problems and economically manufacturing a tin-electroplated cold-rolled steel strip, the following methods have so far been proposed:

(1) A method for manufacturing a tin-electroplated cold-rolled steel strip, disclosed in Japanese Patent Provisional Publication No. 3-177,597 published on Aug. 1, 1991, which comprises the steps of: degreasing a cold-rolled steel strip, then subjecting the degreased cold-rolled steel strip to a continuous annealing treatment; then temper-rolling, following the continuous annealing treatment, the continuously annealed cold-rolled steel strip; and then, subjecting, following the temper-rolling, the temper-rolled cold-rolled steel strip to a continuous tin-electroplating treatment in a tin-electroplating bath without pickling same (hereinafter referred to as the "prior art 1").

(2) A method for manufacturing a tin-electroplated cold-rolled steel strip, disclosed in Japanese Patent Provisional Publication No. 3-207,887 published on Sep. 11, 1991, which comprises the steps of: degreasing a cold-rolled steel strip, then, subjecting the degreased cold-rolled steel strip to a continuous annealing treatment; then, temper-rolling, following the continuous annealing treatment, the continuously annealed cold-rolled steel strip; then, pickling, following the temper-rolling, the temper-rolled cold-rolled steel strip; and then, subjecting, following the pickling, the pickled cold-rolled steel strip to a continuous tin-electroplating treatment in a tin-electroplating bath (hereinafter referred to as the "prior art 2").

The above-mentioned prior art 1 has the following problems:

Among the manufacturing steps of the tin-electroplated cold-rolled steel strip, the temper-rolling of the cold-rolled steel strip is very important in imparting satisfactory mechanical properties and shape to the tin-electroplated cold-rolled steel strip. In the prior art 1, the continuous annealing treatment is directly followed by the above-mentioned temper-rolling of the cold-rolled steel strip, and the temper-rolling is directly followed by the continuous tin-electroplating treatment of the temper-rolled cold-rolled steel strip without pickling.

A cold-rolled steel strip may be temper-rolled either by a method without the use of a temper-rolling solution or by a method with the use of a temper-rolling solution. In any of the two methods, friction between the rolling rolls and the cold-rolled steel strip during the temper-rolling inevitably produces iron powder which adheres onto the surface of the cold-rolled steel strip. Furthermore, when the temper-rolling is carried out with the use of a temper-rolling solution, both of iron powder and the temper-rolling solution adhere onto the surface of the cold-rolled steel strip.

Therefore, when subjecting, following the temper-rolling, the temper-rolled cold-rolled steel strip to the continuous tin-electroplating treatment in a tin-electroplating bath, iron powder adhering onto the surface of the cold-rolled steel strip is mixed up into the tin-electroplating bath, and this poses the following problems:

(1) As the cold-rolled steel strip is subjected to the continuous tin-electroplating treatment in the tin-electroplating bath containing iron powder, iron is contained in the tin-electroplating layer formed on at least one surface of the cold-rolled steel strip. As a result, corrosion resistance of the tin-electroplated cold-rolled steel strip is degraded.

(2) Iron powder adhering onto the surface of the cold-rolled steel strip causes a defective plating.

(3) A filter provided in a conduit for circulating the tin-electroplating bath between a tin-electroplating tank and a tin-electroplating solution reservoir, suffers from a clogging caused by iron powder mixed into the tin-electroplating bath. This makes it difficult for the tin-electroplating bath to circulate smoothly between the tin-electroplating tank and the tin-electroplating solution reservoir.

In addition, when the temper-rolling of the cold-rolled steel strip is carried out by the use of a temper-rolling solution, the temper-rolling solution adhering onto the surface of the cold-rolled steel strip disturbs the continuous tin-electroplating treatment in the tin-electroplating bath.

The above-mentioned prior art 2 has the following problems:

In the prior art 2, the temper-rolled cold-rolled steel strip is pickled, following the temper-rolling, and then, the pickled cold-rolled steel strip is subjected to the continuous tin-electroplating treatment in the tin-electroplating bath. Therefore, iron powder and/or the temper-rolling solution adhering onto the surface of the cold-rolled steel strip during the temper-rolling are eliminated by means of the pickling applied following the temper-rolling, thus solving the above-mentioned problem of the prior art 1.

However, the necessity of providing facilities for pickling increases the equipment and running costs, and the whole manufacturing facilities of the tin-electroplated cold-rolled steel strip require a longer space.

Under such circumstances, there is a strong demand for the development of a method which is free from the production of iron powder during a temper-rolling of a cold-rolled steel strip, hence eliminates the necessity of facilities for removing iron powder and/or a temper-rolling solution adhering onto the surface of the cold-rolled steel strip, thus reduces the equipment and running costs and permits manufacture of a tin-electroplated cold-rolled steel strip having an excellent quality, but such a method has not as yet been proposed.

SUMMARY OF THE INVENTION

An object of the present invention is therefore to provide a method which is free from the production of iron powder during a temper-rolling of a cold-rolled steel strip, hence eliminates the necessity of facilities for removing iron powder and/or a temper-rolling solution adhering onto the surface of the cold-rolled steel strip, thus reduces the equipment and running costs and permits manufacture of a tin-electroplated cold-rolled steel strip having an excellent quality.

In accordance with one of the features of the present invention, there is provided a method for manufacturing a tin-electroplated cold-rolled steel strip, which comprises the steps of:

degreasing a cold-rolled steel strip, then subjecting said degreased cold-rolled steel strip to a continuous annealing treatment; then subjecting, following said continuous annealing treatment, said continuously annealed cold-rolled steel strip to a continuous tin-electroplating treatment in a tin-electroplating bath to form, on at least one surface of said cold-rolled steel strip, a tin-electroplating layer having a plating weight within a range of from 0.1 to 2.8 $g/m^2$ per surface of said cold-rolled steel strip; and then temper-rolling, following said continuous tin-electroplating treatment, said cold-rolled steel strip having said tin-electroplating layer on said at least one surface thereof, at a reduction ratio within a range of from 1 to 5%.

DETAILED DESCRIPTION OF PREFERRED EMBODIMENTS

Figure 1:
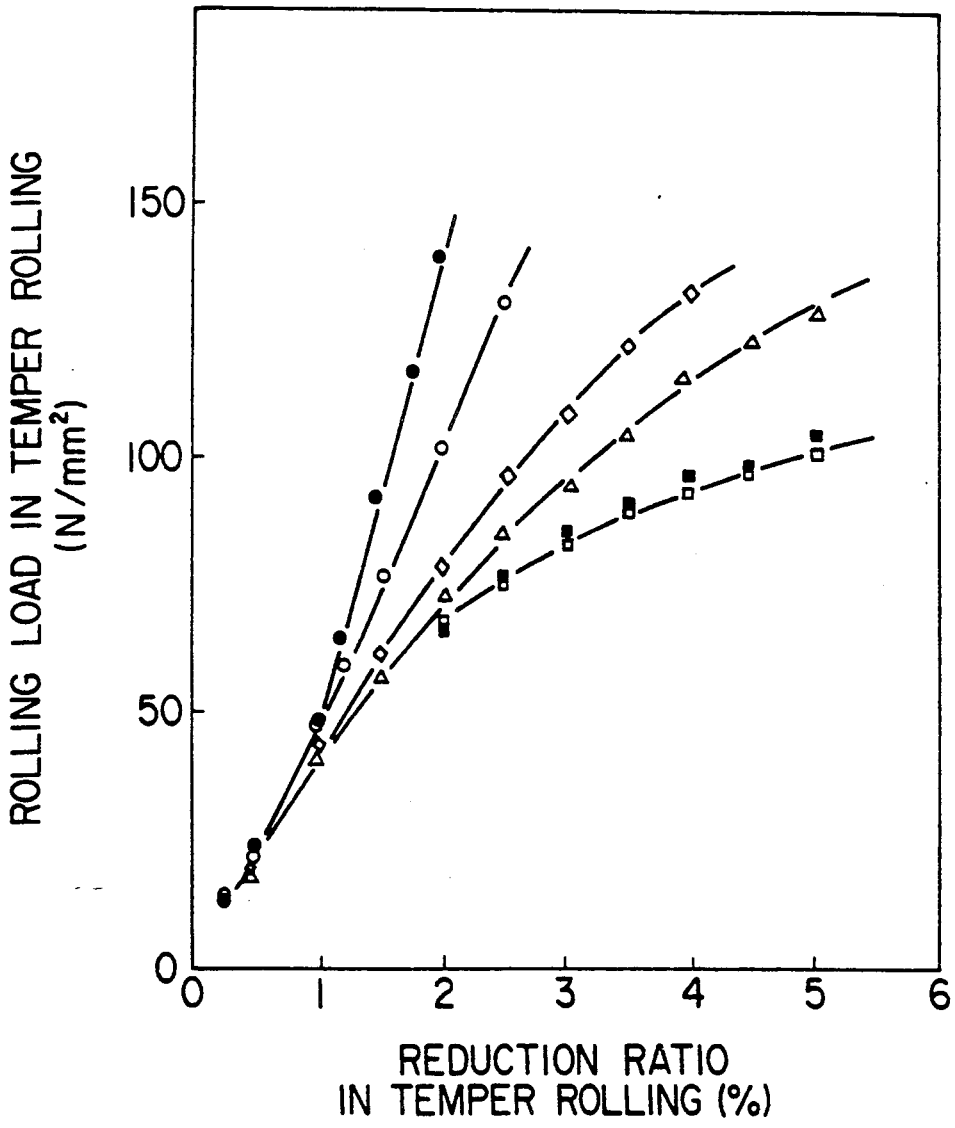
FIG. 1 is a graph illustrating the relationship between a reduction ratio and a rolling load in a temper-rolling for samples of a tin-electroplated cold-rolled steel strip manufactured in accordance with the method of the present invention and for samples of a tin-electroplated cold-rolled steel strip manufactured in accordance with a method outside the scope of the present invention.

From the above-mentioned point of view, extensive studies were carried out to develop a method which is free from the production of iron powder during a temper-rolling of a cold-rolled steel strip, hence eliminates the necessity of facilities for removing iron powder and/or a temper-rolling solution adhering onto the surface of the cold-rolled steel strip, thus reduces the equipment and running costs and permits manufacture of a tin-electroplated cold-rolled steel strip having an excellent quality.

As a result, the following findings were obtained: when manufacturing a tin-electroplated cold-rolled steel strip, iron powder is never produced during a temper-rolling of a cold-rolled steel strip, by carrying out the temper-rolling of the cold-rolled steel strip after the formation of a tin-electroplating layer on at least one surface of the cold-rolled steel strip. This eliminates the necessity of the conventional facilities for removing iron powder and/or the temper-rolling solution, thus permitting reduction of the equipment and running costs, and manufacture of a tin-electroplated cold-rolled steel strip having an excellent quality.

The present invention was made on the basis of the above-mentioned findings. The method of the present invention is described below.

In the method of the present invention, a tin-electroplated cold-rolled steel strip is manufactured in the following steps: degreasing a cold-rolled steel strip, then, subjecting the degreased cold-rolled steel strip to a continuous annealing treatment; then, subjecting, following the continuous annealing treatment, the continuously annealed cold-rolled steel strip to a continuous tin-electroplating treatment in a tin-electroplating bath to form, on at least one surface of the cold-rolled steel strip, a tin-electroplating layer having a plating weight within a range of from 0.1 to 2.8 g/m$^2$ per surface of the cold-rolled steel strip; and then, temper-rolling, following the continuous tin-electroplating treatment, the cold-rolled steel strip having the tin-electroplating layer on at least one surface thereof, at a reduction ratio within a range of from 1 to 5%.

In the method of the present invention, as described above, the temper-rolling of the cold-rolled steel strip is carried out after the formation of the tin-electroplating layer on at least one surface of the cold-rolled steel strip. Consequently, iron powder is never produced during the temper-rolling and never adheres onto the surface of the cold-rolled steel strip. This eliminates the necessity of the conventional facilities for removing iron powder, produced during the temper-rolling, and/or the temper-rolling solution, thus permitting simplification of the manufacturing steps of the tin-electroplated cold-rolled steel strip.

In addition, the tin-electroplating layer formed on at least one surface of the cold-rolled steel strip imparts an excellent lubricity to the cold-rolled steel strip. It is therefore possible to reduce the rolling load in the temper-rolling carried out following the continuous tin-electroplating treatment.

According to the method of the present invention, as described above, iron powder is never produced during the temper-rolling, and the rolling load in the temper-rolling is reduced. This reduces wear of the rolling rolls during the temper-rolling, thus reducing the frequency of replacement thereof. Furthermore, it is possible to carry out a temper-rolling of a large rolling reduction ratio, which has required the use of a temper-rolling solution in the conventional practice, without the use of the temper-rolling solution.

The plating weight of the tin-electroplating layer formed on at least one surface of the continuously annealed cold-rolled steel strip should be limited within a range of from 0.1 to 2.8 g/m$^2$ per surface of the cold-rolled steel strip. With a plating weight of the tin-electroplating layer of under 0.1 g/m$^2$ per surface of the cold-rolled steel strip, it is impossible to satisfy rust prevention and lubricity requirements of the tin-electroplated cold-rolled steel sheet for a DI can, and it is also impossible to reduce the rolling load in the temper-rolling conducted following the tin-electroplating treatment. With a plating weight of the tin-electroplating layer of over 2.8 g/m$^2$ per surface of the cold-rolled steel strip, on the other hand, no further effect cannot be obtained, thus resulting in an uneconomical operation.

The continuous tin-electroplating treatment of the continuously annealed cold-rolled steel strip is carried out by a known method in an acidic tin-electroplating bath such as a known ferrostan plating bath or halogen plating bath, or a known alkaline tin-electroplating bath.

In the present invention, the continuously annealed cold-rolled steel strip is subjected, following the continuous annealing treatment, to a continuous tin-electroplating treatment in the above-mentioned tin-electroplating bath. As a result, oxides and the like are almost non-existent or existent only in a slightest amount on the surface of the continuously annealed cold-rolled steel strip. The continuous tin-electroplating treatment of the continuously annealed cold-rolled steel strip can therefore be carried out without pickling.

It is very favorable to apply a continuous tin-electroplating treatment to the continuously annealed cold-rolled steel strip in an alkaline tin-electroplating bath. More specifically, even when oxides and the like are produced on the surface of the cold-rolled steel strip, application of the continuous tin-electroplating treatment in the alkaline tin-electroplating bath eliminates an adverse effect of oxides and the like.

When carrying out the continuous tin-electroplating treatment in an acidic tin-electroplating bath, the continuously annealed cold-rolled steel strip may as required be pickled prior to the continuous tin-electroplating treatment. In this case, pickling of a very slight degree suffices as compared with pickling for removing iron powder and/or the temper-rolling solution as in the prior art 2.

The reduction ratio in the temper rolling to be applied, following the continuous annealing treatment, to the cold-rolled steel strip having the tin-electroplating layer on at least one surface thereof, should be limited within a range of from 1 to 5%. With a temper rolling reduction ratio of under 1%, a desired effect of the temper rolling is not available. With a temper rolling reduction ratio of over 5%, on the other hand, a defect such as peeloff or breakage may tend to easily occur in the tin-electroplating layer formed on at least one surface of the cold-rolled steel strip.

The temper rolling to be applied, following the continuous tin-electroplating treatment, to the cold-rolled steel strip having the tin-electroplating layer on at least one surface thereof, may be conducted without the use of a temper-rolling solution or with the use thereof. When using a temper-rolling solution, a temper-rolling solution comprising fatty acid ester fats and oils should be employed. The temper-rolling solution comprising the fatty acid ester fats and oils acts also as a rust-preventive lubricant oil to be applied onto the surface of the tin-electroplated cold-rolled steel strip. It is not therefore necessary to remove this kind of temper-rolling solution remaining on the surface of the tin-electroplated cold-rolled steel strip after the temper rolling.

It has not so far been conducted to subject, following the continuous tin-electroplating treatment, the cold-rolled steel strip having the tin-electroplating layer on at least one surface thereof to the temper rolling, as in the method of the present invention. The reason is that the temper rolling has been believed to cause a defect such as peeloff or breakage of the tin-electroplating layer.

As a method for manufacturing a cold-rolled steel strip for a thin and high-strength tin-electroplated cold-rolled steel sheet, a method called the DR (Double Reduction) method is known, which comprises subjecting a cold-rolled steel strip to a continuous annealing treatment, and then cold-rolling again the continuously annealed cold-rolled steel strip. It has once been tried, when manufacturing a cold-rolled steel strip by the DR method, to subject, prior to the second cold rolling of the cold-rolled steel strip, the continuously annealed cold-rolled steel strip to a continuous tin-electroplating treatment to form a tin-electroplating layer on at least one surface of the first cold-rolled steel strip. However, because such a defect as peeloff or breakage was caused in the tin-electroplating layer during the second cold rolling, this trial has not as yet been industrialized.

In the above-mentioned trial, however, the second cold rolling of the cold-rolled steel strip having the tin-electroplating layer formed on at least one surface thereof, was conducted at a reduction ratio within a range of from 20 to 50%. The temper rolling in the method of the present invention is conducted in contrast at a reduction ratio within a range of from 1 to 5%. Application of the temper rolling at such a small reduction ratio to the cold-rolled steel strip having the tin-electroplating layer formed on at least one surface thereof, therefore, never results in a damage to the tin-electroplating layer.

Following the temper rolling, the temper-rolled tin-electroplated cold-rolled steel strip may be subjected to a chromating treatment to form a chromating film on the surface of the tin-electroplating layer. Formation of the chromating film on the surface of the tin-electroplating layer permits further improvement of oxidation resistance, bare corrosion resistance and paint adhesion of the tin-electroplated cold-rolled steel strip.

The chromating film may be formed, for example, by immersing the temper-rolled tin-electroplated cold-rolled steel strip in a chromating solution such as a sodium bichromate solution, or by subjecting the steel strip to a cathodic electrolysis in a chromating solution, or by any other known method. When the temper rolling has been done by the use of a temper-rolling solution comprising fatty acid ester fats and oils, it is necessary to conduct the chromating treatment after removing the temper-rolling solution remaining on the surface of the tin-electro-plating layer.

Following the temper rolling, a rust-preventive lubricant oil may be applied onto the surface of the tin-electroplated cold-rolled steel strip. By applying the rust-preventive lubricant oil onto the surface of the tin-electroplated cold-rolled steel strip, it is possible to further improve bare corrosion resistance of the tin-electroplated cold-rolled steel strip. Furthermore, since lubricity is improved by the rust-preventive lubricant oil thus applied, it is possible to smoothly carry out packaging operations of the tin-electroplated cold-rolled steel strip cut into a sheet having a prescribed size, and to prevent occurrence of such defects as flaws in the tin-electroplated cold-rolled steel sheets during such operations. When conducting the temper rolling with the use of a temper-rolling solution comprising fatty acid ester fats and oils, the temper-rolling solution remaining on the surface of the tin-electroplated cold-rolled steel strip acts also as a rust-preventive lubricant oil as described above. In this case, therefore, it is not necessary to apply a rust-preventive lubricant oil.

Following the chromating treatment, a rust-preventive lubricant oil may be applied onto the surface of the chromating film.

The tin-electroplated cold-rolled steel strip manufactured in accordance with the method of the present invention is used mainly for the can body of the DI can, but is applicable also for each can body of the drawn and redrawn can, the drawn and thin redrawn can, or the three-piece can used after the application of painting of the inner surface.

Now, the method of the present invention is described further in detail by means of examples while comparing with comparative examples.

EXAMPLE 1

Both surfaces of each of a plurality of cold-rolled steel strips each having a thickness of 0.245 mm were electrolytically degreased, then water-rinsed and dried. Then, each cold-rolled steel strip thus electrolytically degreased was subjected to a continuous annealing treatment in a reducing atmosphere.

Subsequently, following the continuous annealing treatment, the continuously annealed cold-rolled steel strip was subjected to a continuous tin-electroplating treatment in an acidic tin-electroplating bath under the following conditions, to form, on each of the both surfaces of the cold-rolled steel strip, a tin-electroplating layer having a plating weight within a range of from 0.1 to 2.8 g/m$^2$ per surface of the cold-rolled steel strip, as shown in Table 1.

(a) Composition of the Acidic Tin-electroplating Bath (Ferrostan Bath)

| | |
|---|---|
| (a) Composition of the acidic tin-electroplating bath (ferrostan bath): | |
| divalent tin ions ($Sn^{2+}$) | 30 g/l, |
| tetravalent tin ions ($Sn^{4+}$) | up to 1 g/l, |
| free acid | 20 g/l, |
| glossing agent | up to 10 g/l, |
| (b) Plating bath temperature | 45° C. |
| (c) Plating current density | 35 A/dm$^2$. |

Then, the cold-rolled steel strip having the tin-electroplating layer on each of the both surfaces thereof was temper-rolled, following the continuous tin-electroplating treatment, under the following conditions, either by a method not using a temper-rolling solution (hereinafter referred to as the "dry type") or by a method using a temper-rolling solution comprising fatty acid ester fats and oils (hereinafter referred to as the "wet type"), to prepare samples of the tin-electroplated cold-rolled steel strip within the scope of the present invention (hereinafter referred to as the "samples of the invention") Nos. 1 to 4 as shown in Table 1. Dioctyl sebacate was employed as the temper-rolling solution comprising the fatty acid ester fats and oils in cases where the wet type temper rolling was carried out.

Temper Rolling Conditions

| | |
|---|---|
| (a) Rolling speed | 1.5 m/minute, |
| (b) Tension acting on the strip | |
| Forward tension | 10 N/mm$^2$, |
| Backward tension | 10 N/mm$^2$, |
| (c) Rolling roll diameter | 250 mm, |
| (d) Surface roughness of rolling roll | Rmax about 5 μm (dull finished) |

For comparison purposes, samples of the tin-electroplated cold-rolled steel strip outside the scope of the present invention (hereinafter referred to as the "samples for comparison") Nos. 1 and 2 also shown in Table 1, were prepared under the same conditions as those for the samples of the invention Nos. 1 to 4 except that the continuously annealed cold-rolled steel strip was temper-rolled prior to the continuous tin-electroplating treatment.

TABLE 1

| No. | Tin-electroplating weight ($g/m^2$) | Type of temper rolling |
|---|---|---|
| Sample of the invention | | |
| 1 | 0.1 | Dry |
| 2 | 1.1 | Dry |
| 3 | 2.8 | Dry |
| 4 | 2.8 | Wet |
| Sample for comparison | | |
| 1 | — | Dry |
| 2 | — | Wet |

For each of the samples of the invention Nos. 1 to 4 and the samples for comparison Nos. 1 and 2, the relationship between the reduction ratio and the rolling load during the temper rolling was investigated. FIG. 1 is a graph showing the results of the investigation. In FIG. 1, the mark "○" indicates the sample of the invention No. 1; the mark "◇" indicates the sample of the invention No. 2; the mark "Δ" indicates the sample of the invention No. 3; the mark "□" indicates the sample of the invention No. 4; the mark "●" indicates the sample for comparison No. 1; and the mark "■" indicates the sample for comparison No. 2.

As is clear from FIG. 1, the rolling load for each of the samples of the invention Nos. 1 to 3 temper-rolled by the dry type at a reduction ratio of over 1%, was considerably lower than the rolling load for the sample for comparison No. 1 temper-rolled by the dry type at the same reduction ratio. The rolling load for the sample of the invention No. 4 temper-rolled by the wet type, was further lower than that for each of the samples of the invention Nos. 1 to 3 temper-rolled by the dry type at the same reduction ratio.

The rolling load during the temper rolling for each of the samples of the invention Nos. 1 to 4 was remarkably reduced under the effect of a lubricating action of the tin-electroplating layer formed on each of the both surfaces thereof. Furthermore, while iron powder was produced during the temper rolling of the samples for comparison Nos. 1 and 2, iron powder was not produced during the temper rolling of the samples of the invention Nos 1 to 4.

Figure 2:
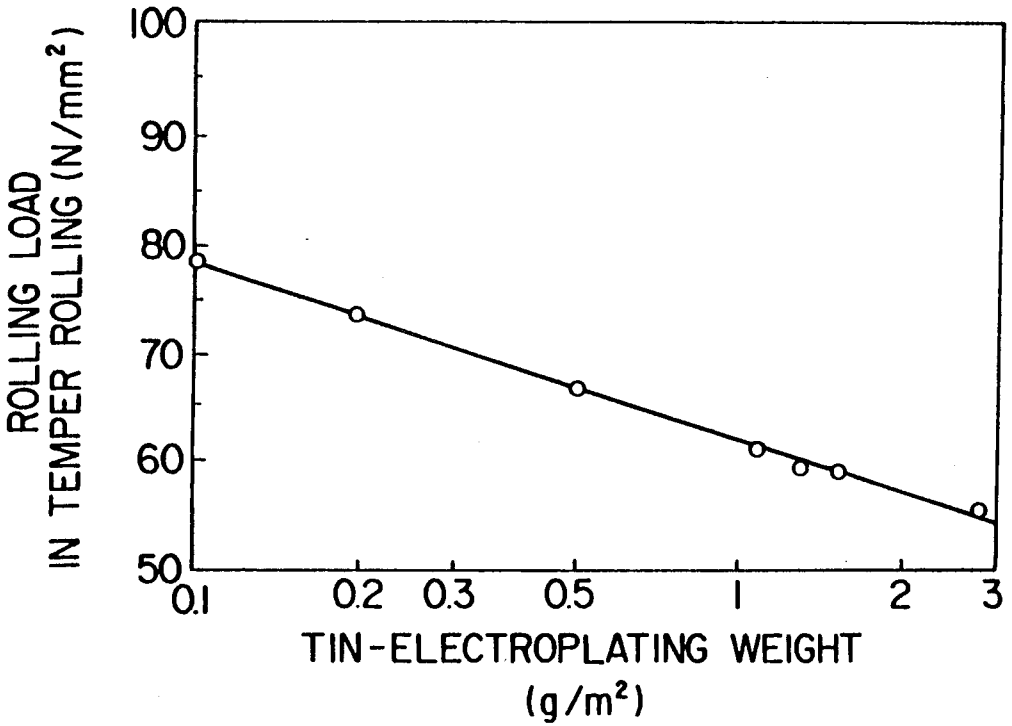
FIG. 2 is a graph illustrating the relationship between a tin-electroplating weight and a rolling load in a temper-rolling for samples of a tin-electroplated cold-rolled steel strip manufactured in accordance with the method of the present invention.

Then, the rolling load when temper-rolling by the dry type at a reduction ratio of 1.5% was investigated for a plurality of samples of the invention, which were different from each other in the plating weight of the tin-electroplating layer formed on each of the both surfaces thereof within the scope of the present invention. FIG. 2 is a graph illustrating the results of the investigation. As is clear from FIG. 2, the rolling load during the temper rolling decreased according as the plating weight of the tin-electroplating layer increased.

EXAMPLE 2

Both surfaces of each of a plurality of cold-rolled steel strips each having a thickness of 0.245 mm were electrolytically degreased, then water-rinsed and dried. Then, each cold-rolled steel strip thus electrolytically degreased was subjected to a continuous annealing treatment in a reducing atmosphere.

Subsequently, the continuously annealed cold-rolled steel strip was electrolytically pickled, or without electrolytically pickling, and then subjected, following the continuous annealing treatment, to a continuous tin-electroplating treatment in an acidic tin-electroplating bath comprising a ferrostan bath or a halogen bath, or in an alkaline tin-electroplating bath. Thus, a tin-electroplating layer having a plating weight of 1.1 $g/mm^2$ or 2.8 $g/m^2$ per surface of the cold-rolled steel strip, was fomed on each of the both surfaces of the cold-rolled steel strip. The electrolytic pickling conditions and the continuous tin-electroplating treatment conditions were as follows:

(A) Electrolytic Pickling Conditions

Composition of pickling solution: sulfuric acid: from 3 to 10 g/l,

Pickling solution temperature: room temperature,

Quantity of electricity: from 7 to 15 coulomb/$dm^2$.

(B) Continuous Tin-electroplating Conditions (1) Tin-electroplating conditions when using an acidic tin-electroplating bath comprising a ferrostan bath:

| | |
|---|---|
| (a) Composition of plating bath | |
| divalent tin ions ($Sn^{2+}$) | 30 g/l, |
| tetravalent tin ions ($Sn^{4+}$) | up to 1 g/l, |
| free acid | 20 g/l, |
| glossing agent | up to 10 g/l, |
| (b) Plating bath temperature | 45° C., |
| (c) Plating current density | 35 A/$dm^2$. |

(2) Tin-electroplating conditions when using an acidic tin-electroplating bath comprising a halogen bath:

| | |
|---|---|
| (a) Composition of plating bath | |
| tin chloride (($SnCl_2$) | 75 g/l, |
| sodium fluoride (NaF) | 25 g/l, |
| potassium fluoride.hydrogen fluoride (KF.HF) | 50 g/l, |
| sodium chloride (Nacl) | 45 g/l, |
| divalent tin ions ($Sn^{2+}$) | 36 g/l, |
| tetravalent tin ions ($Sn^{4+}$) | 1 g/l, |
| glossing agent | 2 g/l, |
| (b) Plating bath temperature | 65° C., |
| (c) Plating current density | 50 A/$dm^2$. |

(3) Tin-electroplating conditions when using an alkaline tin-electroplating bath:

| | |
|---|---|
| (a) Composition of plating bath | |
| divalent tin ions ($Sn^{2+}$) | up to 1 g/l, |
| tetravalent tin ions ($Sn^{4+}$) | 45 g/l, |
| sodium hydroxide (NaOH) | 15 g/l, |
| (b) Plating bath temperature | 85° C., |
| (c) Plating current density | 6.5 A/$dm^2$. |

Then, the cold-rolled steel strip having the tin-electroplating layer on each of the both surfaces thereof, was temper-rolled, following the continuous tin-electroplating treatment, under the same conditions as in the Example 1, at a reduction ratio of 1.0%, 1.5% or 4.0%, either by the dry type or by the wet type, to prepare samples of the invention Nos. 5 to 18 as shown in Table 2.

As shown in Table 2, each of the samples of the invention Nos. 5 to 11 was not electrolytically pickled prior to the tin-electroplating treatment, and on the other hand, each of the samples Nos. 12 to 18 was electrolytically pickled prior to the tin-electroplating treatment.

Each of the samples of the invention Nos. 7 and 14 was subjected, following the temper rolling, to a chromating treatment by means of a immersion method under the following conditions, to form, on the surface of the tin-electroplating layer, a chromating film in an amount of 1.5 mg/m$^2$ as converted into metallic chromium per surface of the cold-rolled steel strip.

for comparison Nos. 11 to 18, the continuously annealed cold-rolled steel strip was electrolytically pickled. In the samples for comparison Nos. 7 to 10 and Nos. 15 to 18, the temper-rolled cold-rolled steel strip was subjected to a pre-treatment for removing iron powder produced during the temper rolling and/or the temper-rolling solution, prior to the continuous tin-electroplating treatment.

TABLE 2

| No. | Pickling | Tin-electroplating: Plating bath | Tin-electroplating: Plating weight (g/m$^2$) | Temper rolling: Type | Temper rolling: Reduction ratio (%) | Chromating | Exterior appearance | Bare corrosion resistance |
|---|---|---|---|---|---|---|---|---|
| Sample of the Invention | | | | | | | | |
| 5 | — | Alkaline | 1.1 | Dry | 1.0 | — | ◎ | ○ |
| 6 | — | Alkaline | 2.8 | Dry | 1.5 | — | ◎ | ◎ |
| 7 | — | Alkaline | 1.1 | Dry | 1.0 | ○ | ◎ | ◎ |
| 8 | — | Alkaline | 1.1 | Wet | 4.0 | — | ◎ | ◎ |
| 9 | — | Alkaline | 2.8 | Wet | 4.0 | — | ◎ | ◎ |
| 10 | — | Ferrostan | 2.8 | Dry | 1.5 | — | ◎ | ◎ |
| 11 | — | Halogen | 2.8 | Dry | 1.5 | — | ◎ | ◎ |
| 12 | ○ | Ferrostan | 1.1 | Dry | 1.0 | — | ◎ | ○ |
| 13 | ○ | Ferrostan | 2.8 | Dry | 1.5 | — | ◎ | ◎ |
| 14 | ○ | Ferrostan | 1.1 | Dry | 1.0 | ○ | ◎ | ◎ |
| 15 | ○ | Ferrostan | 1.1 | Wet | 4.0 | — | ◎ | ◎ |
| 16 | ○ | Ferrostan | 2.8 | Wet | 4.0 | — | ◎ | ◎ |
| 17 | ○ | Halogen | 2.8 | Dry | 1.5 | — | ◎ | ◎ |
| 18 | ○ | Halogen | 2.8 | Wet | 4.0 | — | ◎ | ◎ |

TABLE 3

| No. | Pickling | Temper rolling: Type | Temper rolling: Reduction ratio (%) | Pre-treatment | Tin-electroplating: Plating bath | Tin-electroplating: Plating weight (g/m$^2$) | Chromating | Exterior appearance | Bare corrosion resistance |
|---|---|---|---|---|---|---|---|---|---|
| Sample for comparison | | | | | | | | | |
| 3 | — | Dry | 1.0 | — | Alkaline | 1.0 | — | ○ | X |
| 4 | — | Dry | 1.5 | — | Alkaline | 2.8 | — | ○ | X |
| 5 | — | Wet | 4.0 | — | Alkaline | 2.8 | — | X | X |
| 6 | — | Dry | 1.5 | — | Ferrostan | 2.8 | — | ○ | X |
| 7 | — | Dry | 1.0 | ○ | Alkaline | 1.1 | — | ○ | ○ |
| 8 | — | Dry | 1.5 | ○ | Alkaline | 2.8 | — | ◎ | ◎ |
| 9 | — | Wet | 4.0 | ○ | Alkaline | 2.8 | — | ◎ | ◎ |
| 10 | — | Wet | 4.0 | ○ | Ferrostan | 2.8 | — | ◎ | ◎ |
| 11 | ○ | Dry | 1.0 | — | Ferrostan | 1.1 | — | ○ | X |
| 12 | ○ | Dry | 1.5 | — | Ferrostan | 2.8 | — | ○ | X |
| 13 | ○ | Wet | 4.0 | — | Ferrostan | 2.8 | — | X | X |
| 14 | ○ | Dry | 1.5 | — | Halogen | 2.8 | — | ○ | X |
| 15 | ○ | Dry | 1.0 | ○ | Ferrostan | 1.1 | — | ○ | ○ |
| 16 | ○ | Dry | 1.5 | ○ | Ferrostan | 2.8 | — | ◎ | ◎ |
| 17 | ○ | Wet | 4.0 | ○ | Ferrostan | 2.8 | — | ◎ | ◎ |
| 18 | ○ | Wet | 1.5 | ○ | Halogen | 2.8 | — | ◎ | ◎ |

Chromating Conditions

| | | |
|---|---|---|
| (a) | Composition of chromating solution | |
| | Sodium bichromate ($Na_2CrO_7$) | 30 g/l, |
| (b) | pH value of chromating solution | 4.0, |
| (c) | Temperature of chromating solution | 40° C., |
| (d) | Immersion time | 1 second. |

For comparison purposes, samples for comparison Nos. 3 to 18 as shown in Table 3 were prepared under the same conditions as those for the samples of the invention Nos. 5 to 18 except that the continuously annealed cold-rolled steel strip was temper-rolled prior to the continuous tin-electroplating treatment.

As shown in Table 3, in the samples for comparison Nos. 3 to 10, the continuously annealed cold-rolled steel strip was not electrolytically pickled, and in the samples An exterior appearance and bare corrosion resistance were investigated for each of the samples of the invention Nos. 5 to 18 and the samples for comparison Nos. 3 to 18. The results of the investigation are shown in Table 2 for the samples of the invention Nos. 5 to 18, and in Table 3 for the samples for comparison Nos. 3 to 18.

(1) Exterior Appearance

Each of the samples of the invention Nos. 5 to 18 and the samples for comparison Nos. 3 to 18 was degreased by means of an organic solvent, and then, the exterior appearance of each of the degreased samples was visually checked up for evaluation. The criteria for evaluation were as follows:

◎: The surface of the sample is free from plating irregularities and blurs and is excellent in exterior appearance;

○: The surface of the sample contains slight plating irregularities and blurs, which do not impair the exterior appearance in practice; and X: The surface of the sample suffers from much plating irregularities and blurs, resulting in a defective exterior appearance.

(2) Bare Corrosion Resistance

Each of the samples of the invention Nos. 5 to 18 and the samples for comparison Nos. 3 to 18 was degreased by means of an organic solvent, then each of the degreased samples was exposed indoors, and then, the period until dot-shaped rust was produced on the surface of each sample, was investigated for evaluation. The criteria for evaluation were as follows:

◎: After the exposure, dot-shaped rust was produced during a period of from 15 to 21 days in an area of 80 mm×80 mm of the sample;

○: After the exposure, dot-shaped rust was produced during a period of from 8 to 14 days in the above-mentioned area; and X: After the exposure, dot-shaped rust was produced within seven days in the above-mentioned area.

As is clear from Table 3, each of the samples for comparison Nos. 3 to 6, in which the continuously annealed cold-rolled steel strip was temper-rolled following the continuous annealing treatment, then subjected, following the temper rolling, to a continuous tin-electroplating treatment, showed a low bare corrosion resistance. The sample for comparison No. 5, in which the temper rolling was conducted by the wet type, had a poor exterior appearance.

While each of the samples for comparison Nos. 7 to 10, in which the temper-rolled cold-rolled steel strip was subjected, prior to the continuous tin-electroplating treatment, to a pre-treatment for removing iron powder produced during the temper rolling and/or the temper-rolling solution, were satisfactory in the exterior appearance and bare corrosion resistance, the above-mentioned pre-treatment required increased equipment and running costs.

Each of the samples for comparison Nos. 11 to 14, in which the continuously annealed cold-rolled steel strip was pickled following the continuous annealing treatment, then temper-rolled following the pickling, and then subjected, following the temper rolling, to a continuous tin-electroplating treatment, showed a low bare corrosion resistance. The sample for comparison No. 13, in which the temper rolling was conducted by the wet type, had a poor exterior appearance.

While each of the samples for comparison Nos. 15 to 18, in which the temper-rolled cold-rolled steel strip was subjected, prior to the continuous tin-electroplating treatment, to a pre-treatment for removing iron powder produced during the temper rolling and/or the temper-rolling solution, were satisfactory in the exterior appearance and bare corrosion resistance, the above-mentioned pre-treatment required increased equipment and running costs.

All the samples of the invention Nos. 5 to 18, in contrast, in which the cold-rolled steel strip having a tin-electroplating layer was temper-rolled following the continuous tin-electroplating treatment, were excellent in the exterior appearance and bare corrosion resistance. Furthermore, for all the samples of the invention Nos. 5 to 18, iron powder was not produced during the temper rolling, so that it was not necessary to provide facilities for removing iron powder and/or the temper-rolling solution, prior to the continuous tin-electroplating treatment.

According to the method of the present invention, as described above in detail, it is possible to avoid the production of iron powder during a temper rolling of a cold-rolled steel strip, hence eliminate the necessity of facilities for removing iron powder and/or a temper-rolling solution adhering onto the surface of the cold-rolled steel strip, thus reduce the equipment and running costs, as well as to manufacture a tin-electroplated cold-rolled steel strip having an excellent quality.

What is claimed is:

1. A method for manufacturing a tin-electroplated cold-rolled steel strip, which comprises the steps of:

degreasing a cold-rolled steel strip, then subjecting said degreased cold-rolled steel strip to a continuous annealing treatment; then subjecting, following said continuous annealing treatment, said continuously annealed cold-rolled steel strip to a continuous tin-electroplating treatment in a tin-electroplating bath to form, on at least one surface of said cold-rolled steel strip, a tin-electroplating layer having a plating weight within a range of from 0.1 to 2.8 g/m$^2$ per surface of said cold-rolled steel strip; and then temper-rolling, following said continuous tin-electroplating treatment, said cold-rolled steel strip having said tin-electroplating layer on said at least one surface thereof, at a reduction ratio within a range of from 1 to 5%.

2. A method as claimed in claim 1, wherein:

said continuous tin-electroplating treatment is carried out in an acidic tin-electroplating bath.

3. A method as claimed in claim 1, wherein:

said continuous tin-electroplating treatment is carried out in an alkaline tin-electroplating bath.

4. A method as claimed in claim 2, wherein:

said continuously annealed cold-rolled steel strip is pickled prior to said continuous tin-electroplating treatment.

5. A method as claimed in any one of claims 1 to 4, wherein:

said temper rolling is carried out without using a temper-rolling solution.

6. A method as claimed in any one of claims 1 to 4, wherein:

said temper rolling is carried out using a temper-rolling solution comprising fatty acid ester fats and oils.

7. A method as claimed in any one of claims 1 to 4, wherein:

said temper-rolled cold-rolled steel strip is subjected to a chromating treatment following said temper rolling to form a chromating film on the surface of said tin-electroplating layer.

8. A method as claimed in claim 5, wherein:

said temper-rolled cold-rolled steel strip is subjected to a chromating treatment following said temper rolling to form a chromating film on the surface of said tin-electroplating layer.

9. A method as claimed in claim 6, wherein:

said temper-rolled cold-rolled steel strip is subjected to a chromating treatment following said temper rolling to form a chromating film on the surface of said tin-electroplating layer.

10. A method as claimed in any one of claims 1 to 4, wherein:

a rust-preventive lubricant oil is applied onto the surface of said tin-electroplating layer following said temper rolling.

11. A method as claimed in claim 5, wherein:

a rust-preventive lubricant oil is applied onto the surface of said tin-electroplating layer following said temper rolling.

12. A method as claimed in claim 7, wherein:

a rust-preventive lubricant oil is applied onto the surface of said chromating film following said chromating treatment.

13. A method as claimed in claim 8, wherein:

a rust-preventive lubricant oil is applied onto the surface of said chromating film following said chromating treatment.

14. A method as claimed in claim 9, wherein:

a rust-preventive lubricant oil is applied onto the surface of said chromating film following said chromating treatment.

* * * * *